US006610452B2

(12) United States Patent
Combes et al.

(10) Patent No.: US 6,610,452 B2
(45) Date of Patent: Aug. 26, 2003

(54) TONER COMPOSITIONS WITH SURFACE ADDITIVES

(75) Inventors: James R. Combes, Burlington (CA); Richard P. N. Veregin, Mississauga (CA); Mary L. McStravick, Fairport, NY (US); Ronald J. Koch, Webster, NY (US); Anita C. Van Laeken, Macedon, NY (US); Bing R. Hsieh, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/683,544

(22) Filed: Jan. 16, 2002

(65) Prior Publication Data

US 2003/0134217 A1 Jul. 17, 2003

(51) Int. Cl.[7] ..... G03G 9/08
(52) U.S. Cl. ..... 430/108.11; 430/108.6; 430/108.7; 430/137.1

(58) Field of Search ..... 430/108.11, 108.6, 430/108.7, 137.1

(56) References Cited

U.S. PATENT DOCUMENTS

| | | | | | |
|---|---|---|---|---|---|
| 4,973,540 | A | * | 11/1990 | Machida et al. | 430/108.11 |
| 5,827,632 | A | * | 10/1998 | Inaba et al. | 430/108.7 |
| 6,022,661 | A | * | 2/2000 | Kurose et al. | 430/108.7 |
| 6,403,271 | B1 | * | 6/2002 | Suzuki et al. | 430/108.7 |
| 2002/0061457 | A1 | * | 5/2002 | Okuno et al. | 430/108.7 |

OTHER PUBLICATIONS

Brady, James et al. General Chemistry. New York: John Wiley & Sons. (1982) pp. 286–287.*

* cited by examiner

*Primary Examiner*—Christopher Rodee
(74) *Attorney, Agent, or Firm*—Oliff & Berridge, PLC.

(57) ABSTRACT

A toner composition includes a binder, a colorant, and surface-treated sol-gel metal oxide particles surface-treated with a treatment agent.

8 Claims, No Drawings

TONER COMPOSITIONS WITH SURFACE ADDITIVES

BACKGROUND OF THE INVENTION

1. Field of Invention

This invention is related to toner for developing electrostatic images for use in electrophotography or electrostatic recording.

2. Description of Related Art

There are many known electrophotographic processes for recording an ink image on a recording medium. In these processes, an electrostatic latent image is formed on a photosensitive member by any suitable means. The electrostatic latent image is then developed with a toner. The resultant toner image is typically transferred to a recording medium, such as paper. The toner image is fixed on the recording medium by any suitable process, such as by heating, pressure application, treatment with a solvent vapor, or a combination thereof. The residual toner remaining on the photosensitive member is cleaned off the photosensitive member by any suitable means, such as by using a cleaning blade. The cleaning blade is typically comprised of a rubbery elastic material. The cleaning blade is pressed against the photosensitive member to clean the residual toner off the photosensitive member.

SUMMARY OF THE INVENTION

A small particle size toner is necessary to achieve high image quality. However, a small particle size toner is known to cause slippage, or passing-by, of the toner between the photosensitive member and the cleaning blade. Thus, the residual toner is not effectively cleaned off the photosensitive member by the cleaning blade.

Several techniques have been attempted to prevent slippage of the toner particles between the cleaning blade and the photosensitive member. These techniques include increasing the contact pressure between the photosensitive member and the cleaning blade, and increasing the coefficient of friction of the cleaning blade by changing the cleaning blade material. However, these techniques have failed for several reasons, such as breakage of the cleaning blade edge or filming of the photosensitive member.

A small particle size toner also tends to have a large triboelectric charge. The large triboelectric charge of small particle size toners inhibits transfer of the toner from the photosensitive member surface to an image recording medium, or from the photosensitive member surface to an intermediate transfer medium and from the intermediate transfer medium to the image recording medium. Accordingly, a toner should have a small particle size, as well as exhibit good cleanability and transferability. Various toner compositions are well known in the art, and have been produced having a wide range of additives and constituent materials. Generally, however, the toner particles include a binding material such as a resin, a colorant such as a dye and/or a pigment, and any of various additives to provide particular properties to the toner particles.

One type of additive that is commonly used in toner compositions is a surface additive. Toner surface additives are usually in the form of fine powders with primary particle sizes in the range of from about 5 to about 500 nanometers. The surface additive can be incorporated for any of various reasons, including for providing improved charging characteristics, improved flow properties, and the like.

For example, toner compositions with certain surface additives, including certain silicas, are known. Examples of these additives include colloidal silicas, such as AEROSILS like 972™ available from Degussa, metal salts and metal salts of fatty acids inclusive of zinc stearate, aluminum oxides, cerium oxides, and mixtures thereof.

Sol-gel silicas have been discovered to impart additional advantages to xerographic developers that were not possible using conventional "fumed" metal oxides. Sol-gel silicas are silicas synthesized by the controlled hydrolysis and condensation of tetraethoxysilane. The sol-gel process is typically carried out in alcohol solvents with added homopolymer solutes to control the structure of the precipitated silicon dioxode product. Examples of alcohol solvents used in the sol-gel process include methanol, ethanol and butanol.

The transfer efficiency of toners treated with sol-gel silicas as external additives has been demonstrated to be superior to toners treated with "fumed" silica. The superiority of the sol-gel metal oxides is believed to be due to the spherical silica particles produced by the sol-gel process. One theory as to why this performance discrepancy exists is that inter-particle chain entanglements are evident for "fumed" silica particles, due to their branched structures. The spherical sol-gel silica particles, however, do not entangle.

While sol-gel silicas as toner surface additives have greatly improved transfer efficiency, particularly of small particles size toners, they have not been able to solve the filming and cleaning problems of small particle size toner. Sol-gel silicas, such as KE-P-10 and KE-P-30 silicas, available from Esprit Inc., as delivered, are not surface modified. The surfaces of sol-gel silicas typically contain a high amount of residual solvent, such as methanol and butanol, from the synthesis process. For example, the surface of the sol-gel silicas can contain upwards of 10 wt % of methanol and butanol. Removal of the residue on sol-gel silicas is necessary for effective surface treatment and, thereafter, for the proper cleaning and filming performance of the prepared toner.

The present invention addresses these problems by using, as a toner particle surface additive, a treated sol-gel silica or other sol-gel metal oxide. Use of the treated sol-gel metal oxide provides significant benefits to the toner compositions. The treated sol-gel metal oxide allows for improved cleaning of residual toner from the photosensitive member. The treated sol-gel metal oxide also prevents filming of the photosensitive member.

In particular, the present invention provides a toner composition including a binder, a colorant, and sol-gel metal oxide particles surface-treated with a treatment agent.

These and other features and advantages of this invention are described in, or are apparent from, the following detailed description of various exemplary embodiments of the systems and methods according to this invention.

DETAILED DESCRIPTION OF PREFERRED EMBODIMENTS

According to the present invention, a toner is provided that includes at least a binder, a colorant, and a surface additive. The surface additive is a sol-gel metal oxide that is surface treated by a suitable treatment agent, preferably by a halogenated reagent, a silane, or a combination thereof.

As used herein, a "sol-gel" metal oxide is a metal oxide produced by a sol-gel process, as compared to one produced by other well-known processes, such as fuming. It has been found that the sol-gel process imparts different properties to the resultant metal oxide product. For example, metal oxides formed by a sol-gel process have been found to be more spherical than metal oxides formed by other processes. Thus, for example, a sol-gel silica is a silica synthesized by the controlled hydrolysis and condensation of tetraethoxysilane or other suitable starting material. The sol-gel process is typically carried out in alcohol solvents with added homopolymer solutes to control the structure of the precipitated silicon dioxide product.

As the base material for the surface additive, any suitable sol-gel metal oxide material can be used. Suitable metal oxides include, but are not limited to, silica, titania, ceria, zirconia, alumina, mixtures thereof, and the like. For example, suitable sol-gel metal oxide products include KEP-10 and KEP-30, both of which are sol-gel silicas available from ESPRIT, Inc. and X24 available from Shin-Etsu Chemical Co.

Preferably, the sol-gel metal oxide has a primary particle size of from about 100 nanometers to about 600 nanometers Because the sol-gel metal oxides typically disperse as primary particles, the penchant for inter-particle cohesion via chain entanglements is minimized. However, sol-gel metal oxide materials having sizes outside of these ranges can be used, in embodiments.

Any of a wide variety of surface treatment agents can be used to treat the sol-gel metal oxide. In embodiments, the treatment agent used to treat the sol-gel metal oxide particles is preferably a halogen-containing compound, such as a fluorine-containing compound, a silane compound, such as an alkylsilane, alkoxysilane, or alkylalkoxysilane, or a combination thereof, such as a fluorosilane.

When halogenated metal oxides are desired, any suitable halogen-containing compound can be used as the treatment agent. For example, suitable halogenated treatment agents include, but are not limited to, fluorocarbons such as Halar® ethylene-chlorotrifluoroethylene copolymer (ECTFE) (available from Allied Chemical Corporation, Morristown, N.J.), Tefzel® ethylene-tetrafluoroethylene (ETFE) (available from E.I. duPont de Nemours and Co. Wilmington, Del.), polytetrafluoroethylene (PTFE), polytetrafluoroethylene fluorinated ethylene propylene (PTFE-FEP), polytetrafluoroethylene perfluoroalkoxy (PTFE-PFA), and polyvinylidene fluoride (PVDF), mixtures thereof, and the like. Alternatively, other halogen-containing compounds, i.e., containing chlorine, bromine iodine and/or astatine, can also be used.

In embodiments, polytetrafluoroethylene (or TEFLON®) is particularly preferred. PTFE treated sol-gel metal oxides, such as PTFE treated sol-gel silica, has been found to provide reduced surface energy, which improves cleaning of spherical toner particles. Any suitable PTFE particles can be used to treat sol-gel metal oxides, such as Algoflon™, available from DuPont, and Polymist™, available from Ausimont.

The metal oxide particles can be treated with the halogen-containing compound in any suitable manner. For example, PTFE coated sol-gel silica particles can be prepared by mechanical blending of the sol-gel silica particles with PTFE particles. PTFE particles are relatively soft; thus, the PTFE particles can be directly deposited on silica particles by mechanical forces.

In embodiments, various silane compounds can also be used as the treatment agent. As mentioned above, such silane compounds can be, for example, alkylsilanes, alkoxysilanes, alkylalkoxysilanes, or a combination thereof, such as a fluorosilane or a copolymer of a fluorosilane and an alkylsilane made via silylation chemistry. More preferably, the treatment agent is an alkylalkoxysilane such as a alkylpolyalkoxysilane.

When alkylalkoxysilanes are used as the treatment agent, the alkyl group of the silane preferably contains from 1 to about 25 carbon atoms, preferably from about 4 to about 18 carbon atoms. For example, suitable alkyl groups include, but are not limited to, butyl, hexyl, octyl, decyl, dodecyl, or stearyl (octadecanyl). When alkylsilanes or alkoxysilanes are used as the treatment agent, the alkoxy group of the silane preferably contains from 1 to about 10 carbon atoms.

In embodiments, the alkylalkoxysilane can be represented by the following formula (I):

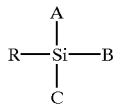

wherein R represents an alkyl group and A, B, and C independently represent alkoxy groups.

Examples of preferred treatment agents thus include, but are not limited to, hexamethyldisilazane (HDMS); decyltrialkoxysilane such as decyltriethoxysilane (DTES) and decyltrimethoxysilane (DTMS); octyltrialkoxysilane such as octyltriethoxysilane (OTES) and octyltrimethoxysilane (OTMS); (heptadecafluoro-1,1,2,2-tetrahydrodecyl) triethoxysilane (FDTES); (tridecafluoro-1,1,2,2-tetrahydrooctyl)triethoxysilane mixtures thereof and the like. Other suitable treatment agents can also be used.

By way of example only, a typical sol-gel silica is received from the manufacturer with adsorbed alcohols such as methanol and butanol. The surface of the particle can be represented by the following formula:

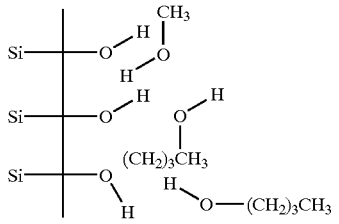

As received, sol-gel silica typically contains from about 7 to about 10 percent by weight of solvent residue, such as methanol or butanol. The solvent residue on the sol-gel silica contributes to poor cleaning and filming performance of the sol-gel silica. Thus, in one exemplary embodiment of the invention, the solvent residue must be removed by vacuum and thermal treatment and subsequently the sol-gel silica is surface-treated with a suitable surface reagent. Thus, for example, when the silica surface is treated with fluorosilane and alkylsilane, the surface of the particle can be represented by the following formula:

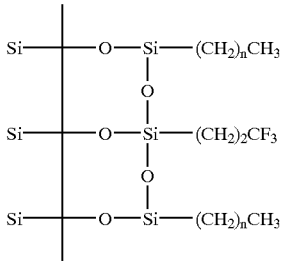

According to the present invention, the treatment agent can be present on the sol-gel metal oxide particles in any suitable amount to provide desired results. In embodiments, the treatment agent is present in an amount of from about 2 to about 25 percent by weight, based on the weight of the sol-gel metal oxide particles. Preferably, the treatment agent is present in an amount of from about 5 to about 20 percent by weight, and more preferably from about 10 to about 20 percent by weight, based on the weight of the sol-gel metal oxide particles. However, values outside these ranges can be used, in embodiments.

Generally, the amount of the treatment agent on the sol-gel metal oxide particle surface can be determined from and/or controlled by the feed rate or feed amount of a precursor material, such as an alkylalkoxysilane. In embodiments, to achieve the desired treatment level, the feed amount of the precursor material is from about 1 or about 2.5 to about 25 or about 30 weight percent of the sol-gel metal oxide. Preferably, the feed amount of the precursor material is from about 5 to about 20 weight percent, more preferably from about 5 to about 15 weight percent.

The various embodiments of the toner of this invention include the exemplary embodiments of the surface treated sol-gel silica toner surface additives discussed above. The toner of this invention has reduced filming propensity on the photoreceptor while maintaining acceptable cleaning properties and relative humidity (RH) stability. The general composition of the various embodiments of the toner of this invention comprises an emulsion aggregation (EA) toner, a surface treated sol-gel silica, such as X24 from Shin-Etsu Chemical Co., a surface treated fumed silica such as RY-50 from DeGussa or TG308F from Cab-O-Sil Inc., and a surface treated titania such as SMT5103 from Tayca.

The toner compositions of the present invention generally also include at least a toner resin and a colorant. In addition, the toner compositions can include one or more conventional additives, including but not limited to, optional charge enhancing additives and optional waxes, especially low molecular weight waxes with an Mw of, for example, from about 1,000 to about 20,000.

As the toner (or binder) resin, any of the convention toner resins can be used. Illustrative examples of such suitable toner resins include, for example, thermoplastic resins such as vinyl resins in general or styrene resins in particular, and polyesters. Examples of suitable thermoplastic resins include, but are not limited to, styrene methacrylate; polyolefins; styrene acrylates, such as PSB-2700 obtained from Hercules-Sanyo Inc.; polyesters, styrene butadienes; crosslinked styrenic polymers; epoxies; polyurethanes; vinyl resins, including homopolymers or copolymers of two or more vinyl monomers; and polymeric esterification products of a dicarboxylic acid and a diol comprising a diphenol. Other suitable vinyl monomers include, but are not limited to, styrene; p-chlorostyrene; unsaturated mono-olefins such as ethylene, propylene, butylene, isobutylene and the like; saturated mono-olefins such as vinyl acetate, vinyl propionate, and vinyl butyrate; vinyl esters such as esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, and acrylamide; mixtures thereof; and the like. In addition, crosslinked resins, including polymers, copolymers, and homopolymers of styrene polymers, may be selected.

For example, as one toner resin, there can be selected the esterification products of a dicarboxylic acid and a diol comprising a diphenol. Other specific toner resins include, but are not limited to, styrene/methacrylate copolymers, and styrene/butadiene copolymers; Pliolites; suspension polymerized styrene butadienes; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol; reactive extruded resins, especially reactive extruded polyesters with crosslinking, styrene acrylates, and mixtures thereof. Also, waxes with a molecular weight Mw of from about 1,000 to about 20,000, such as polyethylene, polypropylene, and paraffin waxes, can be included in, or on the toner compositions as fuser roll release agents.

The toner resin is generally present in any sufficient, but effective amount. For example, the toner resin is generally present in an amount of from about 50 to about 95 percent by weight of the toner composition. More preferably, the toner resin is generally present in an amount of from about 70 to about 90 percent by weight of the toner composition.

The toner composition also generally includes a colorant. As desired, the colorant can be a dye, a pigment, a mixture of a dye and a pigment, or two or more of them. As colored pigments, there can be selected, for example, various known cyan, magenta, yellow, red, green, brown, or blue colorants, or mixtures thereof. Specific examples of pigments include, but are not limited to, phthalocyanine HELIOGEN BLUE L6900™, D6840™, D7080™, D7020™, PYLAM OIL BLUE™, PYLAM OIL YELLOW™, PIGMENT BLUE 1™, available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, CINQUASIA MAGENTATA™ available from E.I. DuPont de Nemours & Company, Pigment Yellow 180, Pigment Yellow 12, Pigment Yellow 13, Pigment Yellow 14, Pigment Yellow 17, Pigment Blue 15, Pigment Blue 15:3, Pigment Red 122, Pigment Red 57:1, Pigment Red 81:1, Pigment Red 81:2, Pigment Red 81:3, and the like.

Generally, colored dyes and pigments that can be selected are cyan, magenta, or yellow pigments, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be selected include copper tetra(octadecyl sulfonamido)phthalocyanine, x-copper phthalocyanine pigment listed in the Color Index as CI 74160, CI Pigment Blue, and Anthrathrene Blue, identified in the Color Index as CI 69810, Special Blue X-2137, and the like. Illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Other soluble dyes, such as red, blue, green, and the like, can also be used, as desired.

Generally, the colorant is included in the toner composition in known amounts, for the desired color strength. For example, the above-described dyes and pigments, and others, can be included in the toner composition in any suitable amount, such as from about 1 to about 20 percent by weight of the toner composition. Preferably, the colorant is included in an amount of from about 2 to about 10 percent by weight of the toner composition.

If desired, such as to give the toner composition magnetic properties, magnetites can also be included in the toner composition, either for their magnetic properties, or for the colorant properties, or both. Suitable magnetites that can be used in the toner compositions of the present invention include, but are not limited to, a mixture of iron oxides ($FeO.Fe_2O_3$), including those commercially available as MAPICO BLACK™ The magnetite can be present in the toner composition in any of various effective amounts, such as an amount of from about 10 percent by weight to about 75 percent by weight of the toner composition. Preferably, the magnetite is present in an amount of from about 30 percent to about 55 percent by weight of the toner composition.

There can be included in the toner compositions of the present invention charge additives as indicated herein in various effective amounts, such as from about 1 to about 15, and preferably from about 1 to about 3, percent by weight of the toner composition. Such suitable charge additives can include the above-described coated alumina particles, or other charge additives well known in the art.

Furthermore, the toner compositions of the present invention can also include suitable waxes for their known effect. Suitable waxes include, but are not limited to, polypropylenes and polyethylenes commercially available from Allied Chemical and Petrolite Corporation; Epolene N-15 commercially available from Eastman Chemical Products, Inc.; Viscol 550-P, a low weight average molecular weight polypropylene available from Sanyo Kasei K.K.; mixtures thereof, and the like. The commercially available polyethylenes selected possess, for example, a weight average molecular weight of from about 1,000 to about 1,500, while the commercially available polypropylenes utilized are believed to have a weight average molecular weight of from about 4,000 to about 7,000. Many of the polyethylene and polypropylene compositions useful in the present invention are illustrated in British Patent No. 1,442,835, the entire disclosure of which is incorporated herein by reference.

The wax can be present in the toner composition of the present invention in various amounts. However, generally these waxes are present in the toner composition in an amount of from about 1 percent by weight to about 15 percent by weight, and preferably in an amount of from about 2 percent by weight to about 10 percent by weight, based on the weight of the toner composition.

The surface treated sol-gel silica of the various embodiments of the toner of this invention have a particle size in the range of 100 nm to 600 nm. Sol-gel silicas having a particle size of from 100 to 150 nm showed optimum attachment to an EA toner surface relative to sol gel particles of larger diameters. Good attachment of sol-gel particles to a toner's surface is needed to minimize filming, because filming is associated with the detachment of silica particles. Thus, the most preferred particle size for the sol-gel silica is in the range of 80 nm to 200 nm.

Table 1 below shows the filming/cleaning results of a series of toner developers based on a trial cyan EA toner with three surface additives during a long cleaning experiment using a T7070 blade. The results shown in Table 1 illustrate the improved filming and cleaning performance of EA toners with surface treated sol-gel silica surface additives of the various exemplary embodiments according to this invention. The three surface additives of the EA toner are JMT3103, RY50 and sol gel silica. JMT3103 is a DTMS treated titania, RY50 is a polydimethylsiloxane treated fumed silica and the sol gel silica is X24 (140 nm, treated with HMDS) or KE-P-10(100 nm).

TABLE 1

| TONER (T-7 CYAN WITH 3-ADDITIVE PACKAGE) | NO. OF PRINTS FOR CLEANING FAILURE | NO. OF PRINTS FOR FILMING FAILURE |
|---|---|---|
| JMT/RY/X24 = 1.46/1.14/2.22 | 13k | 13k |
| JMT/RY/KEP10 (15% DTMS) | 9k | no filming at >20k |
| JMT/RY/KEP10 (3.5% OTES) | 4k | X grade filming at 2k |
| JMT/RY/KEP10 (HDMS) | 9k | X grade filming at 3k |
| JMT/RY/KEP10 (non-treated) | 2k | filming Δ at 2k |

Table 1 shows that the developer with X24 sol-gel silica has a cleaning failure at 13 k prints and a filming failure at 13 k prints with the T7070 blade. The developer with KEP-10 sol-gel silica treated with 15% DTMS shows cleaning failure at 9 k prints and no filming even at 20 k prints. In comparison, the non-treated KEP-10 shows cleaning failure at 2 k prints and filming at 2 k prints.

Thus, KEP-10 sol-gel silica treated with DTMS shows improved cleaning and filming characteristics over non-treated KE-P-10. In addition, the KE-P-10 sol-gel silica treated with DTMS shows improved filming performance over X24 sol-gel silica.

While the invention has been described in conjunction with the specific embodiments described above, it is evident that many alternatives, modifications and variations are apparent to those skilled in the art. Accordingly, the preferred embodiments of the invention set forth above are intended to be illustrative and not limiting. Various changes can be made without departing from the spirit and scope of the invention.

What is claimed is:

1. A toner composition, comprising:

a binder;

a colorant; and sol-gel metal oxide particles surface treated with a treatment agent, wherein the treatment agent is polytetrafluoroethylene.

2. The toner composition according to claim 1, wherein the sol-gel metal oxide is a sol-gel silica.

3. The toner composition according to claim 2, wherein the sol-gel silica particles have a particle size of about 100 to 600 nm.

4. The toner composition according to claim 1, wherein the treatment agent is present in an amount from about 2 to about 25 weight percent, based on a weight of the sol-gel metal oxide particles.

5. The toner composition according to claim 1, further comprising a wax.

6. The toner composition according to claim 1, wherein the colorant is selected from a group consisting of cyan, magenta, yellow, red, orange, green, and violet.

7. A method of preparing a toner composition, comprising:

mixing a resin and a colorant to form toner particles; and applying treated sol-gel metal oxide particles treated with a treatment agent to an external surface of the toner particles, wherein the treatment agent is polytetrafluoroethylene.

8. The method according to claim 7, wherein the sol-gel metal oxide is a sol-gel silica.

* * * * *